United States Patent [19]

Honkura et al.

[11] Patent Number: 4,705,581

[45] Date of Patent: Nov. 10, 1987

[54] SOFT MAGNETIC STAINLESS STEEL

[75] Inventors: Yoshinobu Honkura, Konan; Kouji Murata; Takashi Yokoyama, both of Tokai, all of Japan

[73] Assignee: Aichi Steel Works, Ltd., Tokai, Japan

[21] Appl. No.: 851,159

[22] Filed: Apr. 14, 1986

[30] Foreign Application Priority Data

Apr. 16, 1985 [JP] Japan ..... 60-81001

[51] Int. Cl.[4] ..... C22C 38/28

[52] U.S. Cl. ..... 148/307; 148/310; 420/41; 420/60; 420/61; 420/68; 420/70

[58] Field of Search ..... 148/31.55, 307, 310; 75/126 Q, 126 D, 126 J, 126 M, 124; 420/41, 60, 61, 68, 70

[56] References Cited

U.S. PATENT DOCUMENTS 3,615,367 10/1971 Tanczyn ..... 75/126 D
4,059,462 11/1977 Masumoto et al. ..... 148/31.55

FOREIGN PATENT DOCUMENTS 51-8736 3/1976 Japan .
51-8740 3/1976 Japan .
58-14870 3/1983 Japan .
59-232258 12/1984 Japan .

*Primary Examiner*—Melvin J. Andrews
*Assistant Examiner*—Deborah Yee
*Attorney, Agent, or Firm*—Oblon, Fisher, Spivak, McClelland & Maier

[57] ABSTRACT

A soft magnetic stainless steel consisting essentially of, by weight, up to 0.03% of C, 2.0 to 3.0% of Si, up to 0.40% of Mn, 0.015 to 0.050% of S, 10 to 13% of Cr, 0.05 to 0.20% of Ti, up to 0.03% of N, up to 0.010% of Al, and the balance of Fe and inevitable impurities, with a proviso that the C+N content is not more than 0.05%. The steel has a maximum permeability of not less than 4400 and a magnetic flux density of not less than 12,000 G as magnetic properties, together with a fatigue strength after welding of not lower than 120 kgf $cm^2$, retains the magnetic properties even after annealing at a high temperature of 920° C., and is excellent in electrical resistance, corrosion resistance, mechanical properties and machinability.

3 Claims, 5 Drawing Figures

SOFT MAGNETIC STAINLESS STEEL

BACKGROUND OF THE INVENTION

1. Field of the Invention

The present invention relates to a soft magnetic stainless steel having excellent magnetic properties, electrical properties, weldability, heat treatability, corrosion resistance, mechanical properties and machinability and suitable for use as a material for stationary cores and movable cores of solenoid operated valves or the like.

2. Description of the Prior Art

Hitherto, stationary cores and movable cores of solenoid operated valves and the like have been formed from soft magnetic stainless steels excellent in magnetic properties such as maximum permeability and magnetic flux density as well as electrical resistance, corrosion resistance, mechanical properties and the like.

Recently, in response to the demand for soft magnetic stainless steels having more excellent magnetic and electrical properties, 0.06C-2.2Si-13Cr steels have been developed (with the Si content increased up to 2.2%) and part of which have been put into practical use. Such a soft magnetic stainless steel has good magnetic properties, i.e., a maximum permeability of not less than 2000 and a magnetic flux density of not less than 11,000 G as well as excellent electrical properties such as an electrical resistance of 90 $\mu\Omega$-cm, and further has relatively good corrosion resistance, mechanical properties and workability with excellent quality balance.

However, as solenoid operated valves smaller in size and higher in output and response characteristics have recently been demanded, the abovementioned soft magnetic stainless steels have come to be unsatisfactory in magnetic properties and electrical resistance, and there has been a demand for the development of a soft magnetic stainless steel having more excellent magnetic properties and electrical resistance. Further, the soft magnetic stainless steel has become desired to have a higher fatigue strength after welding, as the range of its use involving welding has been increased.

SUMMARY OF THE INVENTION

It is a primary object of the present invention to provide a soft magnetic stainless steel markedly improved in magnetic properties and also improved in fatigue strength after welding, heat treatability, corrosion resistance, electrical resistance, mechanical properties and machinability.

It is an other object of the present invention to provide a soft magnetic stainless steel having excellent magnetic properties, namely, a maximum permeability of at least 4400 and a magnetic flux density of at least 12,000 G.

It is another object of the present invention to provide a soft magnetic stainless steel which has an excellent fatigue strength after welding of at least 120 kgf/cm$^2$, retains magnetic properties even after annealing at a high temperature of 920° C., thus permitting a treatment thereof in a continuous furnace, not in a batch-type furnace which is conventionally used, thereby leading to a markedly improved productivity, and is also excellent in electrical resistance, corrosion resistance, mechanical properties and mechinability.

It is a further object of the present invention to provide a soft magnetic stainless steel extremely effective for reducing the size and enhancing the output and response characteristics of solenoid operated valves.

The soft magnetic stainless steel according to the present invention consists essentially of, by weight, up to 0.03% of C., 2.0 to 3.0% of Si, up to 0.40% of Mn, 0.015 to 0.050% of S, 10 to 13% of Cr, 0.05 to 0.20% of Ti, up to 0.03% of N, up to 0.010% of Al, and the balance of Fe and inevitable impurities, with a proviso that the C+N content is not more than 0.050%.

The soft magnetic stainless steel according to the present invention may further contain, in addition to the abovementioned constituents, at least one selected from the group consisting of 0.010 to 0.050% of Se, 0.010 to 0.050% of Te, 0.0010 to 0.0100% of Ca and 0.015 to 0.045% of Pb, whereby machinability of the above steel can be further improved.

The soft magnetic stainless steel according to the present invention may contain up to 0.03% of C., 2.0 to 3.0% of Si, up to 0.4% of Mn, 10 to 13% of Cr, 0.05 to 0.20% of Ti, up to 0.03% of N, up to 0.010% of Al, with the C+N content being not more than 0.05%, and further contain at least one selected from the group consisting of up to 3% of Mo, up to 0.50% of Ni, up to 0.50% of Cu and up to 0.005% of S, whereby corrosion resistance of the first named steel can be further improved.

BRIEF DESCRITPION OF THE DRAWINGS

Various other objects, features and attendant adavantages of the present invention will be more fully appreciated as the same becomes better understood from the following detailed description when considered in connection with the accompanying drawings, in which.

DETAILED DESCRIPTION OF THE PREFERRED EMBODIMENTS

The present invention relates to a soft magnetic stainless steel having excellent magnetic properties, electrical properties, weldability, heat treatability, corrosion resistance, mechanical properties and machinability.

The present inventors have investigated the effects of various alloying elements on the magnetic properties, fatigue strength after welding, heat treatability and corrosion resistance of 12Cr steels. As a result, they have found the followings: (1) magnetic properties can be markedly improved by setting the Cr content in the range of 10 to 13%, adding Ti and Si and lowering the C+N content; (2) fatigue strength after welding can be improved by lowering the Al content as well as the C+N content and adding Ti; (3) heat treatability can be improved by adding Ti and lowering the C+N content; and (4) corrosion resistance can be improved by incorporating 10 to 13% of Cr, adding Ti and lowering the C+N content.

Figure 1:
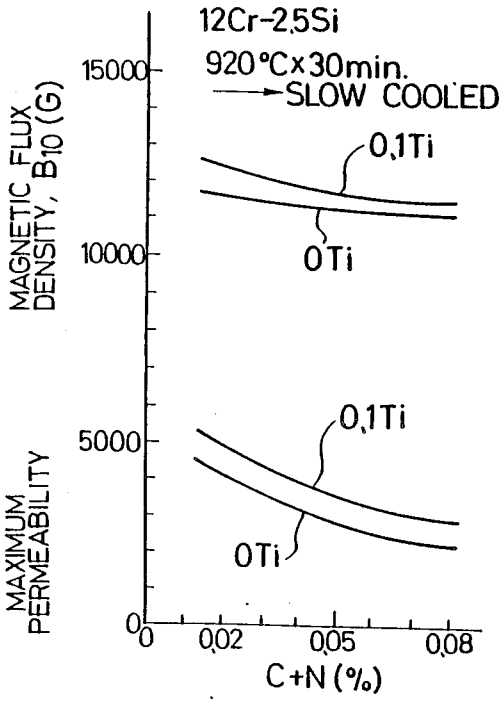
FIG. 1 is a diagram showing the relationships of C+N content with maximum permeability and magnetic flux density.
Figure 2:
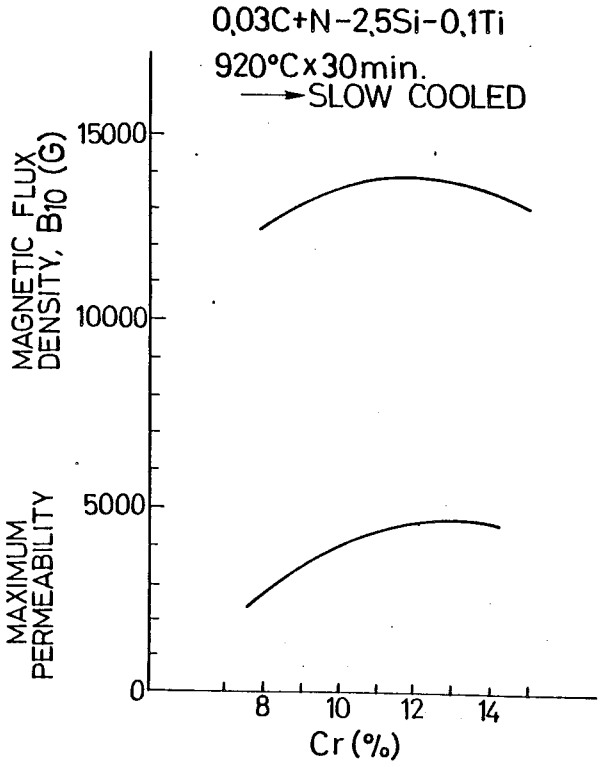
FIG. 2 is a diagram showing the relationships of Cr content with maximum permeability and magnetic flux density.
Figure 3:
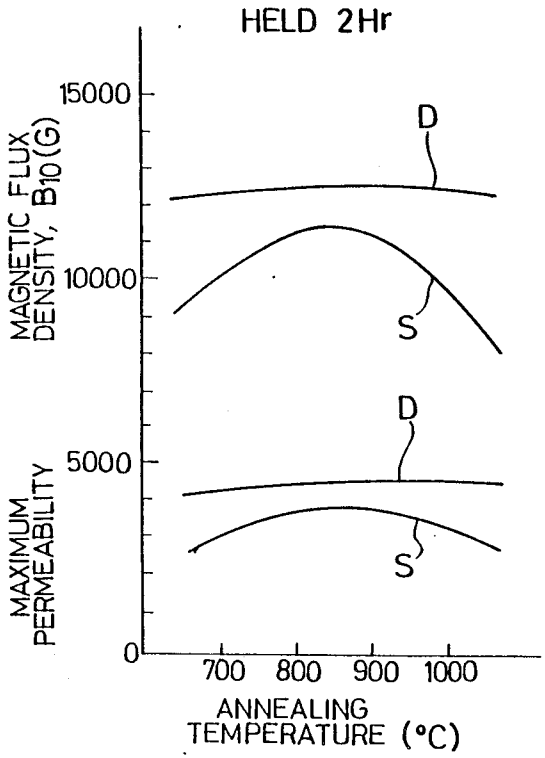
FIG. 3 is a diagram showing the relationships of annealing temperature with maximum permeability and magnetic flux density.
Figure 4:
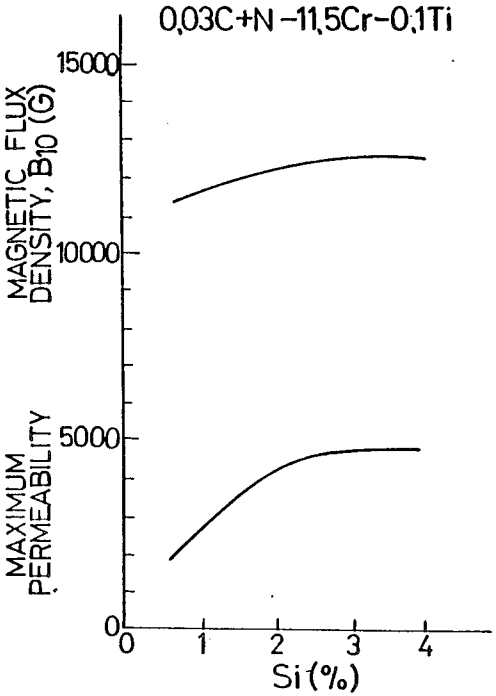
FIG. 4 is a diagram showing the relationships of Si content with maximum permeability and magnetic flux density.

Namely, as shown in FIGS. 1 to 3, in 10–13Cr stainless steels, magnetic properties such as maximum permeability and magnetic flux density are improved by a reduction in the C+N content and the addition of Ti and Si. By setting the C+N content to be not more than 0.05% and incorporating about 0.1% of Ti and not less than 2% of Si, it is possible to obtain a maximum permeability of not lower than 4400 and at least twice better magnetic properties than those of a conventional steel (0.06C.-2.2Si-13Cr). A fatigue strength after welding of 120 kgf/cm$^2$ (twice as high as that of the abovementioned conventional steel) can be obtained by lowering the Al content to 0.010% or below to increase the penetration of the weld zone as well as by adding about 0.1% of Ti and reducing the C+N content to 0.05% or below to enhance the toughness of the weld zone. Further, the addition of about 0.1% of Ti ensures that magnetic properties are not lowered even on annealing at a high temperature of 920° C. after welding, as shown in FIG. 4, and coarsening of crystal grains at high temperatures is suppressed, leading to improved ductility and toughness. Therefore, the conventional annealing at 850° C. for 4 hours in the batch-type furnace can be replaced by annealing at a higher temperature for about 30 minutes in a continuous furnace. The use of the continuous furnace greatly enhances productivity and contributes to a reduction in the heat treatment costs.

Figure 5:
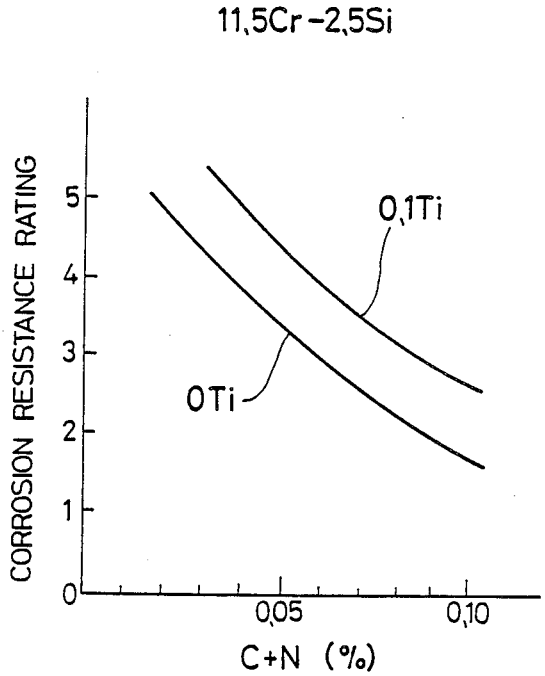
FIG. 5 is a diagram showing the relationshiip between C+N content and corrosion resistance rating evaluated in terms of degree of rusting.

In addition, as shown in FIG. 5, corrosion resistance is improved by the reduction of the C+N content and the addition of about 0.1% of Ti.

Based on the above findings, the present invention has been attained, in which the C+N content of a 12 Cr steel is set to be not more than 0.05%, the Si content is increased into the range of 2.0 to 3.0%, 0.05 to 0.2% of Ti and 0.015 to 0.050% of S are incorporated, and the Al content is limited to 0.010% to below, thereby greatly improving the magnetic properties and also improving fatigue strength after welding, heat treatability, corrosion resistance, electrical resistance, mechanical properties and machinability.

The grounds for the limitations on the composition of the steel according to the present invention will now be explained below.

C is an element which impairs magnetic properties, fatigue strength after welding, heat treatability and corrosion resistance. In the present invention, therefore, the C content is desirably as low as possible, and the upper limit thereof is 0.03%. For further improvement of magnetic properties, weldability and heat treatability, it is desirable to limit the C content to 0.015% or below.

Si is an element which improves magnetic properties such as maximum permeability and magnetic flux density and increases electrical resistance; thus, Si is an important constituent of the soft magnetic steel, and should be incorporated in an amount of not less than 2.0%. However, an Si content of over 3.0% does not promise great improvement of magnetic properties and impairs ductility and toughness. Accordingly, the upper limit of Si content is 3.0%.

Mn, like Si, is an element necessary for deoxidation in the steel making process, and the Mn content is set in such a range as not to impair magnetic properties, the upper limit thereof being 0.40%.

Cr is a primary element which provides the corrosion resistance characteristic of stainless steels, and should be incorporated in the steel in an amount of at least 10%. However, an increase in the Cr content impairs the magnetic properties such as magnetic flux density. Therefore, the upper limit of Cr content is 13%.

Ti greatly improves magnetic properties such as maximum permeability and magnetic flux density, and also improves fatigue strength after welding as well as heat treatability. Further, Ti also improves corrosion resistance, and is a most important element in the present invention. To obtain these advantages, at least 0.05% of Ti should be incorporated in the steel; thus, the lower limit of Ti content is 0.05%. However, an addition of more than 0.20% of Ti leads only to saturation of the advantages. Thus, the upper limit of Ti content is 0.20%.

N is an element which impairs magnetic properties, fatigue strength after welding and heat treatability; therefore, the N content is desirably as low as possible. Thus, the upper limit of N content is 0.03%.

Both C and N are elements which impair magnetic properties, fatigue strength after welding and heat treatability. In the present invention, the C+N content should be as low as possible, and the upper limit thereof is 0.05%.

S is an element which impairs corrosion resistance but improves machinability. To obtain excellent machinability, not less than 0.015% of S should be incorporated in the steel; thus, the lower limit of S content is 0.015%. However, an S content of more than 0.050% leads to a lowering in corrosion resistance, and therefore, the upper limit of S content is 0.050%.

Al is an element which impairs fatigue strength after welding. But, at the same time, Al permits an increase in the penetration of the weld zone and improvement of fatigue strength through a reduction of the amount thereof. In the present invention, the Al content is desirably as low as possible, the upper limit being 0.010%.

Se, Te, Ca and Pb are elements which improve machinability. To obtain excellent machinability, not less than 0.010% of Se or Te, not less than 0.001% of Ca or not less than 0.015% of Pb should be incorporated in the steel. The lower limits are 0.010% for each of Se and Te, 0.001% for Ca, and 0.015% for Pb. However, an addition of more than 0.050% of Se, more than 0.050% of Te, more than 0.045% of Pb or more than 0.010% of Ca impairs magnetic properties. Thus, the upper limits are 0.050% for Se, 0.050% for Te, 0.010% for Ca, and 0.045% for Pb.

Mo, Ni, Cu and S are elements for improving corrosion resistance, according to the present invention.

However, an addition of more than 3% of Mo or more than 0.5% of Ni or Cu impairs magnetic properties. Thus, the upper limits are 3% for Mo, and 0.5% for each of Ni and Cu.

Although S improves machinability, it decreases corrosion resistance. To obtain excellent corrosion resistance, the S content should be lowerted to 0.005% or below; thus, the upper limit of S content is 0.005%.

The characteristic features of the steel according to the present invention will be made clear in comparison with conventional steels and comparative steels in the following description of examples.

Table 1 shows the chemical composition of the test steels.

TABLE 1

| Steels | Chemical composition (% by weight) | | | | | | | | | | | | | | | |
|---|---|---|---|---|---|---|---|---|---|---|---|---|---|---|---|---|
| | C | Si | Mn | S | Cr | Ti | N | Al | Se | Te | Ca | Pb | Mo | Ni | Cu | C + N |
| A | 0.010 | 2.52 | 0.24 | 0.028 | 11.78 | 0.10 | 0.010 | 0.002 | | | | | | | | 0.020 |
| B | 0.007 | 2.21 | 0.18 | 0.020 | 12.72 | 0.07 | 0.08 | 0.003 | | | | | | | | 0.015 |
| C | 0.021 | 2.88 | 0.35 | 0.037 | 11.02 | 0.18 | 0.015 | 0.002 | | | | | | | | 0.036 |
| D | 0.012 | 2.49 | 0.25 | 0.042 | 11.82 | 0.10 | 0.012 | 0.002 | | | | | | | | 0.024 |
| E | 0.011 | 2.53 | 0.27 | 0.021 | 11.75 | 0.07 | 0.017 | 0.004 | 0.020 | | | | | | | 0.028 |
| F | 0.008 | 2.67 | 0.28 | 0.017 | 11.57 | 0.11 | 0.013 | 0.002 | | 0.015 | | | | | | 0.021 |
| G | 0.010 | 2.31 | 0.31 | 0.020 | 12.19 | 0.15 | 0.013 | 0.002 | | | 0.0070 | | | | | 0.023 |
| H | 0.016 | 2.75 | 0.26 | 0.025 | 12.37 | 0.12 | 0.014 | 0.003 | | | | 0.010 | | | | 0.030 |
| J | 0.009 | 2.50 | 0.27 | 0.010 | 11.69 | 0.11 | 0.012 | 0.002 | | | | | 1.20 | | | 0.021 |
| K | 0.007 | 2.66 | 0.23 | 0.008 | 12.13 | 0.09 | 0.012 | 0.002 | | | | | | 0.25 | | 0.024 |
| L | 0.007 | 2.72 | 0.25 | 0.008 | 12.29 | 0.11 | 0.009 | 0.002 | | | | | | | 0.27 | 0.016 |
| M | 0.010 | 2.48 | 0.29 | 0.001 | 11.72 | 0.13 | 0.011 | 0.003 | | | | | | | | 0.021 |
| N | 0.012 | 2.25 | 0.31 | 0.027 | 11.59 | 0.12 | 0.012 | 0.025 | | | | | | | | 0.024 |
| P | 0.025 | 2.28 | 0.29 | 0.026 | 11.47 | 0.00 | 0.017 | 0.04 | | | | | | | | 0.042 |
| Q | 0.052 | 2.41 | 0.25 | 0.018 | 11.88 | 0.11 | 0.021 | 0.02 | | | | | | | | 0.073 |
| R | 0.012 | 1.78 | 0.26 | 0.027 | 11.93 | 0.11 | 0.011 | 0.02 | | | | | | | | 0.023 |
| S | 0.061 | 2.21 | 0.27 | 0.021 | 13.11 | -0.00 | 0.021 | 0.012 | | | | | | | | 0.083 |
| T | 0.042 | 0.45 | 0.45 | 0.007 | 16.10 | 0.00 | 0.017 | 0.011 | | | | | | | | 0.059 |
| U | 0.038 | 0.65 | 0.40 | 0.005 | 13.01 | 0.00 | 0.018 | 0.013 | | | | | | | | 0.056 |

In Table 1, steels A to M are the steels according to the present invention, steels N to R are comparative steels, and steels S to U are conventional steels.

Table 2 shows maximum permeability, magnetic flux density, electrical resistance, hardness, elongation, corrosion resistance, machinability and fatigue strength after welding, of the test steels A to U which have been subjected to a heat treatment comprising heating at 900° C. for 2 hours followed by cooling at a rate of 100° C./hr. As magnetic properties, maximum permeability and magnetic flux density were measured by using a DC-type BH tracer and ring form specimens of 24 mm in outside diameter, 16 mm in inside diameter and 16 mm in thickness. The electrical resistance was determined by the Wheatstone bridge method using 12 mm diameter×500 mm long wires as specimens. The elongation was measured by using JIS No. 4 specimens. As for corrosion resistance, 60-min salt spray tests were carried out using a 3.5% aqueous NaCl solution, and the degree of rusting was determined. The specimens with respective degrees of rusting were given the respective ratings according to the following criteria:

| Degree of rusting | Rating |
|---|---|
| less than 1% | 5 |
| 1% to 10% (exclusive) | 4 |
| 10% to 30% (exclusive) | 3 |
| 30% to 60% (exclusive) | 2 |
| 60 to 100% | 1 |

Machinability was evaluated by measuring the useful life of a drill. Fatigue strength after welding was determined by carrying out pressure fatigue tests on specimens which had been formed in a configuration of a pipe having a thickness of 2 mm and subjected to plasma-arc welding at one end thereof to an end of a pile having a thickness of 2 mm formed with a stainless steel of a material of SUS 304 indicated in Japanese Industrial Standard under the plasma condition of 53 A and 100 V without using a welding rod.

TABLE 2

| Steels | Maximum permeability | Magnetic flux density B10 (G) | Electrical resistance (μ Ω-cm) | Hardness (Hv) | Elongation (%) | Corrosion resistance (rating) | Machinability (mm) | Fatigue strength after welding (kgf/cm$^2$) |
|---|---|---|---|---|---|---|---|---|
| A | 4900 | 12400 | 97 | 182 | 37 | 5 | 640 | 150 |
| B | 5100 | 12500 | 92 | 175 | 38 | 5 | 500 | 140 |
| C | 4400 | 12000 | 103 | 191 | 36 | 5 | 1000 | 150 |
| D | 4600 | 12200 | 96 | 184 | 36 | 5 | 1200 | 120 |
| E | 4500 | 12000 | 97 | 180 | 35 | 4 | 1800 | 120 |
| F | 4600 | 12200 | 98 | 183 | 34 | 4 | 1600 | 120 |
| G | 4600 | 12000 | 94 | 180 | 35 | 5 | 1400 | 120 |
| H | 4400 | 12000 | 100 | 185 | 34 | 5 | 1500 | 120 |
| J | 4800 | 12200 | 96 | 182 | 37 | 5 | — | 150 |
| K | 4400 | 12000 | 97 | 187 | 36 | 5 | — | 130 |
| L | 4400 | 12000 | 98 | 186 | 35 | 5 | — | 120 |
| M | 4400 | 12000 | 94 | 184 | 39 | 5 | — | 150 |
| N | 4500 | 12300 | 92 | 178 | 34 | 5 | 510 | 40 |
| P | 3200 | 11200 | 93 | 177 | 33 | 4 | 450 | 110 |
| Q | 3000 | 11400 | 94 | 190 | 31 | 3 | 300 | 100 |
| R | 3800 | 11600 | 85 | 169 | 37 | 5 | 470 | 120 |
| S | 2300 | 11200 | 92 | 188 | 30 | 3 | 400 | 90 |
| T | 900 | 7800 | 62 | 150 | 31 | 5 | 150 | 40 |
| U | 700 | 5400 | 60 | 145 | 36 | 4 | 140 | 100 |

As seen from Table 2, although the conventional steel S has an excellent electrical resistance of 92 μΩ-cm and an excellent hardness of Hv 188, the magnetic properties thereof are insufficient as indicated by a maximum permeability of 2300 and a magnetic flux density of 11200 G, becuase of the insufficient Ti content as well as the high C+N content and Al content. In addition, the steel S has a poor fatigue strength after welding of 90 kgf/cm$^2$, and has unsatisfactory elongation, corrosion resistance and machinability. The conventional steel T, which is characterized by the low Si content(0.45%), the insufficient Ti content and the high Al, C+N and Cr contents, has very poor magnetic properties as indicated by a maximum permeability of 900 and a magnetic flux density of 7800 G, has a low electrical resistance of 62 $\mu\Omega$-cm, and is poor in fatigue strength after welding, hardness, elongation and machinability. The conventional steel U, which is characterized by the low Si content, the insufficient Ti content and the high Al and C+N contents, has poor magnetic properties, electrical resistance, hardness and machinability.

The comparative steel N has an extremely low fatigue strength after welding of 40 kgf/cm$^2$ because of the high Al content. The comparative steel P, which does not contain Ti, has a low maximum permeability of 3200 and a low magnetic flux density of 11,200 G as well as a low fatigue strength after welding. The comparative steel Q, characterized by the high C and C+N contents, has a low maximum permeability of 3000 and a low magnetic flux density of 11,400 G as well as a low fatigue strength after welding of 100 kgf/cm$^2$, and is poor in corrosion resistance, elongation and machinability. The comparative steel R with the insufficient Si content has a low maximum permeability of 3800 and a low magnetic flux density of 10,600 G as well as a low electrical resistance of 81 $\mu\Omega$-cm.

As contrasted to the above steels, the steels A to M according to the present invention are characterized by the reduced C+N and Al contents, a Ti content of 0.05 to 0.20%, an Si content of 2.0 to 3.0%, an S content of 0.015 to 0.050% and a Cr content of 10 to 13%. As a result of such compositions, these steels have excellent magnetic properties as indicated by a maximum permeability of not less than 4400 and a magnetic flux density of not less than 12,000 G; excellent electrical properties and weldability as indicated by an electrical resistance of not lower than 92 $\mu\Omega$-cm and a fatigue strength after welding of 120 kgf/cm$^2$; and excellent corrosion resistance, mechanical properties and machinability as indicated by a degree of rusting of not more than 10%, a hardness of at least Hv 180, an elongation of at least 35% and a machinability of at least 500 mm.

As has been described above, the soft magnetic stainless steel according to the present invention has magnetic properties markedly improved by the reduced C+N content, the appropriate amount of Ti and the increased Si content, and because of the limited Al content and the reduced C+N content, the steel shows improved fatigue strength after welding, as well as excellent heat treatability, corrosion resistance, mechanical properties and machinability. Accordingly, the soft magnetic stainless steel according to the present invention is suitable for use as a material for stationary cores and movable cores of solenoid operated valves or the like, has high practicality, and can sufficiently cope with the reduction in size and the increase in output and response characteristics of the solenoid operated valves.

What is claimed as new and desired to be secured by Letters Patent of the United States is:

1. A soft magnetic stainless steel having a maximum permeability of not less than 4400, a magnetic flux density of not less than 12,000 G and a fatigue strength after welding of not lower than 120 kgf/cm$^2$, consisting essentially of, by weight, up to 0.03% of C, 2.0 to 3.0% of Si, up to 0.40% of Mn, 0.015 to 0.050% of S, 10 to 13% of Cr, 0.05 to 0.20% of Ti, up to 0.03% of N, up to 0.010% of Al, and the balance of Fe and inevitable impurities, with a proviso that C+N content is not more than 0.050%.

2. A soft magnetic stainless steel having a maximum permeability of not less than 4400, a magnetic flux density of not less than 12,000 G and a fatigue strength after welding of not lower than 120 kgf/cm$^2$, consisting essentially of, by weight, up to 0.03% of C, 2.0 to 3.0% of Si, up to 0.40% of Mn, 0.015 to 0.050% of S, 10 to 13% of Cr, 0.05 to 0.20% of Ti, up to 0.03% of N, up to 0.010% of Al, at least one element selected from the group consisting of 0.010 to 0.050% of Se, 0.010 to 0.050% of Te, 0.0010 to 0.0100% of Ca and 0.015 to 0.045% of Pb, and the balance of Fe and inevitable impurities with a proviso that the C+N content is not more than 0.055.

3. A soft magnetic stainless steel having a maximum permeability of not less than 4400, a magnetic flux density of not less than 12,000 G and a fatigue strength after welding of not lower than 120 kgf/cm$^2$, consisting essentially of, by weight, up to 0.03% of C, 2.0 to 3.0% of Si, up to 0.40% of Mn, 10 to 13% of Cr, 0.05 To 0.20% of Ti, up to 0.03% of N, up to 0.010% of Al, at least one element selected from the group consisting of up to 3% of Mo, up to 0.50% of Ni, up to 0.50% of Cu and up to 0.005% of S, and the balance of Fe and inevitable impurities, with a proviso that the C+N content is not more than 0.05%.

* * * * *